United States Patent [19]

Mae et al.

[11] Patent Number: 4,808,243

[45] Date of Patent: Feb. 28, 1989

[54] HIGH DAMPING ZINC ALLOY WITH GOOD INTERGRANULAR CORROSION RESISTANCE AND HIGH STRENGTH AT BOTH ROOM AND ELEVATED TEMPERATURES

[75] Inventors: Yoshiharu Mae; Akihiko Sakonooka, both of Saitama, Japan

[73] Assignee: Mitsubishi Metal Corporation, Ohte, Japan

[21] Appl. No.: 97,819

[22] Filed: Sep. 16, 1987

Related U.S. Application Data

[63] Continuation of Ser. No. 751,615, Jul. 2, 1985, which is a continuation-in-part of Ser. No. 561,938, Dec. 15, 1983, abandoned.

[30] Foreign Application Priority Data

| | | | |
|---|---|---|---|
| Dec. 20, 1982 | [JP] | Japan | 57-223274 |
| Dec. 20, 1982 | [JP] | Japan | 57-223275 |
| Dec. 20, 1982 | [JP] | Japan | 57-223276 |

[51] Int. Cl.[4] ..... C22F 1/16

[52] U.S. Cl. ..... 148/3; 148/13; 420/518; 420/531; 420/587

[58] Field of Search ..... 420/515, 518, 531, 537, 420/587; 148/441, 442, 3, 13, 438

[56] References Cited

FOREIGN PATENT DOCUMENTS

| | | | |
|---|---|---|---|
| 553873 | 3/1958 | Canada | 420/515 |
| 769484 | 3/1957 | United Kingdom | 420/518 |
| 769485 | 3/1957 | United Kingdom | 420/515 |

*Primary Examiner*—L. Dewayne Rutledge
*Assistant Examiner*—Robert L. McDowell
*Attorney, Agent, or Firm*—Schmeiser, Morelle & Watts

[57] ABSTRACT

A zinc cast alloy is disclosed which contains, by weight, 15–60% Al, 0.05–3% Cu, 0.5–7% Si, 0.01–0.8% Mn, optionally 0.005–0.12% P and/or Na, balance Zn and incidental impurities. The alloy has a high damping characteristic, concurrently with good intergranular corrosion resistance and high resistance to both room and elevated temperatures. To achieve values of more than $1\times10^{-3}$ (internal friction of $Q^{-1}$), 20 $\mu$m (corrosion depth) or less, 10 kg/mm$^2$ or more (0.2% yield strength) at room temperature, and 20 kg/mm$^2$ or more at elevated temperature of 100° C., the alloy has to be subjected to a solution-heat treatment in the range of 300°–400° C., followed by a rapid cooling, preferably a water quench.

5 Claims, No Drawings

HIGH DAMPING ZINC ALLOY WITH GOOD INTERGRANULAR CORROSION RESISTANCE AND HIGH STRENGTH AT BOTH ROOM AND ELEVATED TEMPERATURES

This is a continuation of copending application Ser. No. 751,615, filed July 2, 1985, which in turn is a continuation-in-part of earlier, then copending and now abandoned, application Ser. No. 561,938, filed Dec. 15, 1983, for "High Damping Zinc Alloy Having Excellent Strength at Room Temperature and Elevated Temperatures", of the same applicants.

BACKGROUND OF THE INVENTION

1. Field of the Invention

This invention relates to specific Zinc alloys having high strength at both room temperature and at high temperatures, superb damping capacity and very good intergranular corrosion resistance.

2. Description of the Prior Art

Zn-Al-Cu alloys possessing damping capacity have conventionally been used, for example, as support plates in car audio equipment exposed to vibrations and acoustic covers in industrial sewing machines which generate considerable noise.

Such conventional Zn-Al-Cu alloys have sufficient damping capacity and corrosion resistance. However, they are accompanied by a severe drawback in that, when they are subjected to heat, for example the heat of a car engine in the case of support plates for audio equipment, or the heat from baking of baking finish in the case of acoustic covers for industrial sewing machines, they are reduced in strength and are thus rendered susceptible of undergoing deformation and, moreover, they readily deteriorate in their damping capacity.

It is, therefore, highly desirable to produce a zinc alloy which possesses concurrently a high damping capacity, a good intergranular corrosion resistance and a high strength at both room and elevated temperatures.

SUMMARY OF THE INVENTION

It is an object of the present invention to provide a zinc alloy having, among other properties, certain industrially acceptable characteristics, namely excellent strength at both room and elevated temperatures, superb damping capacity and good intergranular corrosion resistance.

DETAILED DESCRIPTION OF THE INVENTION

With the foregoing in view, the present inventors have investigated the possibility of formulating a zinc alloy which possesses these properties, that is, is excellent especially in strength at elevated temperatures and undergoes little or no deterioration in damping capacity even after being subjected to thermal hysteresis, and has good intergranular corrosion resistance. As a result it has been found that a zinc alloy having the following composition, in weight percent, meets the above requirements:

15 to 60 aluminum
0.05 to 3 copper
0.5 to 7 silicon
0.01 to 0.8 manganese
optionally, 0.005 to 0.12 phosphorus and/or sodium; and balance zinc and incidental impurities.

The present invention has been completed on the basis of the above mentioned findings. The proportion range of each component of the zinc alloy has been limited to the above-defined one for the following reasons:

The component aluminum is effective in improving the damping capacity of an alloy and also in making the alloy lighter. Al contents less than 15 weight percent are, however, insufficient to bring about the above mentioned effects and, when aluminum is present in excess of 60 wt.%, as suggested in some prior art, the damping capacity tends to deteriorate. Therefore, the content of aluminum has been limited to 15–60 wt.%.

Copper acts, when present in combination with aluminum, to improve the corrosion resistance, particularly the intergranular corrosion resistance of an alloy. However, when present in amounts lower than 0.05 wt.% it is incapable of imparting the desired level of intergranular corrosion resistance to the alloy. No additional improvement can be expected when copper is present in excess of 3 wt.%. Thus, the content of copper has been limited to 0.05–3 wt.%.

Silicon is effective for the improvement in the strength of an alloy at both room and elevated temperatures and for the suppression of reduction in damping capacity, even when the alloy is used under conditions involving thermal hysteresis. However, Si contents lower than 0.5 wt.% are unable to exhibit the above mentioned desired effects and, if the content exceeds 7 wt.% excessive dross occurs when melting and casting the alloy. Accordingly, the Si content has been limited to 0.5–7 wt.%.

When incorporated in combination with silicon, manganese serves to improve the ductility and wear resistance of an alloy. A Mn content lower than 0.01 wt.% is, however, insufficient to bring about the above effects to any significant extent. Moreover, if Mn is present in excess of 0.8 wt.%, it induces not only the tendency of deteriorating the ductility, but also, similarly to Si, the occurrance of excessive dross upon the melting and casting of the alloy. In view of these facts, it is desirable to limit the content of manganese to 0.01–0.8 wt.%, so that all the other properties, such as ductility and wear resistance of the alloy, be maintained at the desired levels.

Both phosphorus and sodium are effective for improving still further the ductility of an alloy. They may, thus be optionally added when a particularly high level of ductility is required. However, a total P+Na content lower than 0.005 wt.% is insufficient to insure the desired ductility-improving effect; and when these elements are present in excess of 0.12 wt.% the elongation and the damping capacity of the alloy begins to drop. Therefore, their total content has been limited to 0.005–0.12 wt.%.

Furthermore, it has been found that the properties enumerated hereabove are achieved by subjecting the alloy melt, after the conventional casting, to a solid solution heat treatment in the range of 300°–400° C., followed by rapid cooling, preferably a water quenching, so as to obtain an internal friction value $Q^{-1}$ greater than $1\times10^{-3}$, when measured at a frequency of approximately 800 Hz at room temperature.

With the alloy of the present invention, the solid solution heat treatment requires a temperature higher than the eutectoid temperature (275° C. in a two-phase alloy, such as Zn-Al) which obtains the alpha phase (f.c.c.) of one phase in the Zn-Al two-phase equilibrium and is defined as 300° C., after taking in consideration the usual safety factor. The upper limit requires a temperature lower than the solidus temperature of the alloy and is set at 400° C. in order to avoid such problems as incipient melting.

DESCRIPTION OF PREFERRED EMBODIMENTS

The Zn alloys of this invention will now be described more specifically in conjunction with the following illustrative tests:

In accordance with usual melting practices, there were prepared zinc alloy melt samples (identified numerically) having compositions according to the present invention and comparative melt samples (identified alphabetically) having compositions outside the requirements established as necessary by the inventors. The melts were cast in sand molds, thereby obtaining cast pieces of dimensions suitable for further testing-typically 150 mm×30 mm×10 mm.

In order to impart acceptable damping capacity to the cast pieces, these were subjected to a solid solution heat treatment by holding them for a short period of two hours at preset temperatures within the range of 300°-400° C., followed by quenching in water.

Thereafter, test pieces 6 mm wide, 2 mm thick and 100 mm long were cut from the cast pieces, so as to evaluate their damping capacity, by measuring the internal friction values $Q^{-1}$ at a frequency of about 800 Hz at room temperature.

Furthermore, in order to evaluate their corrosion resistance, particularly the intergranular corrosion resistance, test pieces 50 mm wide, 2 mm thick and 50 mm long were cut from the above cast pieces and exposed to steam at 97° C. and the maximum grain boundary corrosion depths were then measured.

Furthermore, tensile test pieces 3 mm wide, 2 mm thick and 20 mm long were cut from the above cast pieces and their 0.2% yield strength was determined at room temperature, 50° C., 75° C. and 100° C., respectively.

The results of the above test measurements are shown in the accompanying Tables, in which, to repeat, numerically listed alloy samples represent alloys having compositions according to the invention, while samples identified alphabetically represent alloys having compositions outside the limits set by the inventors.

TABLE 1

| Alloy Sample No. | Composition (wt. %) - Balance Zn and Incidental Impurities | | | | | | |
|---|---|---|---|---|---|---|---|
| | Al | Cu | Si | Mn | P | Nn | Zn |
| 1 | 15.3 | 0.51 | 3.19 | 0.31 | — | — | bal. |
| 2 | 22.6 | 0.49 | 3.07 | 0.26 | — | — | bal. |
| 3 | 40.5 | 0.55 | 2.76 | 0.29 | — | — | bal. |
| 4 | 50.3 | 0.51 | 2.91 | 0.33 | — | — | bal. |
| 5 | 59.4 | 0.56 | 3.24 | 0.35 | — | — | bal. |
| 6 | 21.9 | 0.053 | 3.00 | 0.36 | — | — | bal. |
| 7 | 22.9 | 2.93 | 3.23 | 0.22 | — | — | bal. |
| 8 | 22.6 | 0.51 | 0.51 | 0.28 | — | — | bal. |
| 9 | 22.4 | 0.52 | 6.92 | 0.26 | — | — | bal. |
| 10 | 40.7 | 0.49 | 3.06 | 0.013 | — | — | bal. |
| 11 | 39.8 | 0.21 | 2.13 | 0.42 | — | — | bal. |
| 12 | 41.6 | 0.55 | 3.19 | 0.60 | — | — | bal. |
| 13 | 41.2 | 0 41 | 2.75 | 0.79 | — | — | bal. |
| 14 | 39.6 | 0.39 | 2.45 | 0.33 | 0.054 | — | bal. |
| 15 | 37.4 | 0 51 | 2.91 | 0.29 | — | 0.0053 | bal. |
| 16 | 40.1 | 0.55 | 3.50 | 0.25 | 0.116 | — | bal. |
| 17 | 40.3 | 0.53 | 3.56 | — | — | — | bal. |
| 18 | 59.1 | 0.51 | 3.44 | — | — | — | bal. |

TABLE 1-continued

| Alloy Sample No. | Composition (wt. %) - Balance Zn and Incidental Impurities | | | | | | |
|---|---|---|---|---|---|---|---|
| | Al | Cu | Si | Mn | P | Nn | Zn |
| 19 | 15.8 | 0.51 | 2.34 | — | 0.033 | — | bal. |
| 20 | 41.2 | 0.51 | 3.55 | — | 0.017 | 0.029 | bal. |
| 21 | 58.6 | 0.51 | 2.49 | — | — | 0.062 | bal. |
| 22 | 39.8 | 0.51 | 3.00 | — | 0.0053 | — | bal. |
| 23 | 40.8 | 0.50 | 3.01 | — | 0.021 | — | bal. |
| 24 | 41.5 | 0.52 | 3.20 | — | 0.064 | — | bal. |
| 25 | 39.8 | 0.50 | 2.90 | — | 0.118 | — | bal. |
| 26 | 39.7 | 0.51 | 3.05 | — | — | 0.0052 | bal. |
| 27 | 39.3 | 0.50 | 3.09 | — | — | 0.033 | bal. |
| 28 | 40.1 | 0.52 | 2.75 | — | — | 0.117 | bal. |
| A | 13.1 | 0.52 | 3.10 | 0.12 | — | — | bal. |
| B | 62.3 | 0.43 | 3.21 | 0.19 | — | — | bal. |
| C | 21.8 | — | 3.19 | 0.30 | — | — | bal. |
| D | 20.3 | 0.49 | 0.31 | 0.35 | — | — | bal. |
| E | 12.1 | 0.51 | 3.45 | — | — | — | bal. |
| F | 62.8 | 0.23 | 3.56 | — | — | — | bal. |
| G | 22.4 | — | 2.49 | — | — | — | bal. |
| H | 12.3 | 0.53 | 3.01 | — | 0.034 | — | bal. |
| I | 63.4 | 0.52 | 3.00 | — | 0.032 | — | bal. |
| J | 22.5 | — | 2.59 | — | — | 0.061 | bal. |
| K | 23.1 | 0.49 | 0.36 | — | 0.036 | — | bal. |
| L | 21.3 | 0.50 | 3.00 | — | 0.139 | — | bal. |
| M | 20.5 | 0.52 | 3.01 | — | — | 0.143 | bal. |

TABLE 2

| Alloy Sample No. | Internal Friction Value ($\times 10^3$) | Maximum Grain Corrosion Depth ($\mu$) | 0.2% Yield Strength ($Kg/mm^2$) | | | |
|---|---|---|---|---|---|---|
| | | | Room Temp. | 50° C. | 75° C. | 100° C. |
| 1 | 2.0 | 20 | 22.0 | 20.0 | 13.0 | 12.0 |
| 2 | 5.2 | 18 | 23.4 | 20.2 | 13.9 | 11.7 |
| 3 | 3.3 | 5 | 31.6 | 28.8 | 25.6 | 22.9 |
| 4 | 2.8 | 5 | 33.2 | 30.1 | 26.9 | 24.1 |
| 5 | 2.0 | 5 | 21.4 | 21.4 | 21.0 | 20.5 |
| 6 | 5.3 | 17 | 21.9 | 17.1 | 13.9 | 10.6 |
| 7 | 4.8 | 8 | 24.3 | 22.4 | 18.9 | 15.1 |
| 8 | 5.7 | 18 | 20.3 | 18.9 | 15.4 | 12.1 |
| 9 | 3.5 | 16 | 24.5 | 23.1 | 18.7 | 15.3 |
| 10 | 3.2 | 5 | 31.9 | 27.9 | 24.1 | 20.9 |
| 11 | 3.3 | 2 | 31.0 | 27.1 | 24.0 | 21.0 |
| 12 | 3.5 | 2 | 33.1 | 29.3 | 25.9 | 22.4 |
| 13 | 3.1 | 2 | 35.3 | 33.4 | 30.1 | 26.5 |
| 14 | 3.6 | 5 | 31.7 | 28.1 | 23.9 | 21.3 |
| 15 | 3.4 | 3 | 31.5 | 27.4 | 23.9 | 21.5 |
| 16 | 3.2 | 7 | 32.1 | 27.9 | 24.4 | 21.2 |
| 17 | 3.3 | 5 | 31.5 | 28.5 | 23.0 | 18.0 |
| 18 | 2.0 | 5 | 21.4 | 21.8 | 19.8 | 19.0 |
| 19 | 2.0 | 20 | 21.1 | 18.2 | 16.1 | 13.0 |
| 20 | 3.1 | 10 | 32.0 | 30.8 | 26.9 | 22.2 |
| 21 | 2.1 | 7 | 21.8 | 21.5 | 20.1 | 19.2 |
| 22 | 3.3 | 5 | 31.5 | 27.7 | 24.0 | 19.9 |
| 23 | 3.2 | 7 | 32.3 | 28.9 | 26.1 | 21.6 |
| 24 | 3.1 | 7 | 34.5 | 30.4 | 27.3 | 24.5 |
| 25 | 3.2 | 7 | 35.5 | 30.4 | 28.5 | 24.0 |
| 26 | 3.3 | 7 | 31.0 | 26.0 | 22.9 | 20.3 |
| 27 | 3.2 | 7 | 32.5 | 29.1 | 25.8 | 22.2 |
| 28 | 3.0 | 7 | 35.0 | 32.3 | 29.9 | 25.4 |
| A | 0.8 | 17 | 20.1 | 16.1 | 12.9 | 9.5 |
| B | 0.7 | 2 | 21.3 | 21.2 | 21.2 | 20.4 |
| C | 5.3 | 110 | 19.8 | 16.5 | 11.4 | 8.9 |
| D | 5.7 | 30 | 14.3 | 11.9 | 8.9 | 5.5 |
| E | 0.8 | 20 | 20.9 | 18.1 | 15.6 | 12.1 |
| F | 0.9 | 5 | 20.4 | 20.4 | 20.2 | 19.8 |
| G | 5.5 | 100 | 19.0 | 16.6 | 11.4 | 10.0 |
| H | 0.9 | 21 | 19.8 | 15.4 | 12.1 | 9.5 |
| I | 0.7 | 7 | 20.3 | 20.1 | 19.7 | 19.0 |
| J | 5.2 | 100 | 21.5 | 17.6 | 14.3 | 11.7 |
| K | 5.8 | 35 | 12.9 | 10.1 | 8.5 | 6.1 |
| L | 5.0 | 50 | 22.5 | 18.4 | 14.5 | 12.1 |
| M | 4.9 | 50 | 22.5 | 17.3 | 15.5 | 13.0 |

From the results shown in the Tables, it is apparent that the zinc alloys of this invention have individually excellent damping capacity, intergranular corrosion resistance, as well as superb strength both at room temperature and at elevated temperatures, whereas one or more of the afore mentioned characyeristics has deteriorated when the content of at least one of the elements aluminum, copper, silicon and manganese falls outside the required range. Specifically: when aluminum is either too low or too high in content, the internal friction value $Q^{-1}$ may be observed to be very low (see alloys A, B, E, F, H and I); when the copper content is too low (in this case absent) the corrosion depth may be seen to be exceedingly high (see alloys C, G and J); when the silicon content is too low (see alloys D and K), the corrosion depth values are abnormally high and the resistance to heat is very much impaired; finally, when the optional additives P and/or Na exceed the upper limit allowed, it can be seen that the value for the intergranular corrosion depth is elevated beyond the acceptable level (alloys L and M).

Air cooling tests were also conducted to determine the loss in internal friction value $Q^{-1}$ when a slower cooling rate is employed, compared to water quenching. A zinc alloy composed of, by weight, 22% Al, 1.5% Si, 0.5% Cu, 0.3% Mn, balance Zn and incidental impurities was cast in the usual manner into a plate 50 mm wide, 2 mm thick and 100 mm long by a cold chamber type die cast machine. After removal from the die mold, the plate was quenched in water and the plate alloy was found to have an internal friction factor of $5\times10^{-3}$, measured at 800 Hz. On the other hand, when the same alloy was air cooled after removal from the mold, the internal friction value was $2\times10^{-3}$. It is obvious from the above that a superior damping capacity can be obtained by water quenching than by air cooling, after removal from the mold. The reason for this good damping characteristic obtained by the die casting method is that the molten alloy solidifies at about 480° C., after which it undergoes solution heat treatment in the temperature range of 300°-400° C. Thus, the heat treatment effect, such as a solution-heat treatment followed by the quenching, can be performed, since the cooling speed of die casting metallic molds is very high. On the alloy of this example, a higher damping value can be obtained by water quenching than by air cooling, after removal from the mold, because the alloy is very sensitive to the cooling speed.

In a similar comparative test, an alloy composed, by weight, of 40% Al, 3% Si, 1.0% Cu, 0.3% Mn, balance Zn and incidental impurities was cast in the usual manner into a plate 50 mm wide, 2 mm thick and 100 mm long by a cold chamber type die cast machine. After removal from the mold, the plate was quenched in water and the internal friction value $Q^{-1}$, measured at 800 Hz, was $2\times10^{-3}$. Air cooling of the plate, however, resulted in the same internal friction value. Thus, in this case, in practical operation, air cooling may be applied. In this example, after solidifying at about 520° C., a rapid cooling speed with air was sufficient to achieve the acceptable internal friction value. Based on this fact, it is clear that the alloy of this example has a composition such that its cooling speed, after removal from the mold, does not affect the damping property of the alloy.

Consequently, depending on the critical composition of the alloy, the essential rapid cooling may be obtained also by air cooling, although water quenching is usually preferred. This is so because it would be otherwise be necessary to know aforehand whether the particular composition of an alloy solidifies at a temperature such as to permit air cooling of the alloy workpiece.

What is claimed is:

1. Manufacturing method for improving the damping property of alloys, comprising subjecting a zinc cast alloy melt after casting to solution-heat treatment in the range of 300° to 400° C. for sufficient time to obtain substantially homogenous alpha phase of one phase in the two-phase zinc-aluminum alloy equilibrium, and rapidly cooling the casting thereafter, to form a zinc cast alloy exhibiting an internal friction value $Q^{-1}$ greater than $1\times10^{-3}$, as measured at room temperature and at approximately 800 Hz, and having maximum intergranular boundary corrosion depth of about 20 microns and 0.2% yield strength values greater than about 20 $Kg/mm^2$ at room temperature and greater than about 10 $Kg/mm^2$ at 100° C., said alloy consisting of the following composition by weight:

15-60% aluminum
0.05-3% copper
0.5-7% silicon
0.01-0.8% manganese
balance zinc and incidental impurities.

2. Method of claim 1 wherein said rapid cooling of the casting is effected by means of water quenching.

3. The manufacturing method of claim 1 in which the zinc cast alloy exhibits an internal friction value $Q^{-1}$ of about $2\times10^{-3}$ and in which the alloy consists of the following composition by weight:

40% aluminum
3% silicon
1.0% copper
0.03% manganese
balance zinc and incidental impurities.

4. Manufacturing method for improving the damping property of alloys, comprising subjecting a zinc cast alloy melt after casting to solution-heat treatment at a temperature above the eutectoid temperature thereof, but below the solidus temperature thereof for time effective to produce on rapid quenching a zinc cast alloy exhibiting an internal friction factor $Q^{-1}$ greater than $1\times10^{-3}$, as measured at room temperature and at approximately 800 Hz, and then water quenching the resulting solution heat-treated casting and thereby providing a zinc cast alloy article having a maximum intergranular boundary corrosion depth of about 20 microns and 0.2% yield strength values greater than about 20 $kg/mm^2$ at room temperature and greater than about 10 $kg/mm^2$ at 100° C., said alloy consisting of the following composition by weight: 15-60% aluminum, 0.05-3% copper, 0.5-7% silicon, 0.01-0.8% manganese, 0.005-0.12% of one or both of phosphorus and sodium, the sum total of said phosphorus and sodium, if both present, not exceeding 0.12%, balance zinc and incidental impurities.

5. The manufacturing method of claim 4 in which the zinc cast alloy has an internal friction factor $Q^{-1}$ of about $5\times10^{-3}$ and in which the composition of the alloy by weight is:

22% aluminum
1.5% silicon
0.5% copper
0.3% manganese
balance zinc and incidental impurities.

* * * * *